US010637154B2

(12) United States Patent
Xian et al.

(10) Patent No.: US 10,637,154 B2
(45) Date of Patent: Apr. 28, 2020

(54) ARRAY ANTENNA ARRANGEMENT

(71) Applicant: Intel IP Corporation, Santa Clara, CA (US)

(72) Inventors: Liang Xian, Portland, OR (US); Joongheon Kim, San Jose, CA (US); Ali Sadri, San Diego, CA (US)

(73) Assignee: Intel IP Corporation, Santa Clara, CA (US)

( * ) Notice: Subject to any disclaimer, the term of this patent is extended or adjusted under 35 U.S.C. 154(b) by 725 days.

(21) Appl. No.: 15/178,624

(22) Filed: Jun. 10, 2016

(65) Prior Publication Data

US 2017/0358866 A1 Dec. 14, 2017

(51) Int. Cl.
*H01Q 1/38* (2006.01)
*H01Q 21/00* (2006.01)
(Continued)

(52) U.S. Cl.
CPC ..... *H01Q 21/0006* (2013.01); *H01Q 1/38* (2013.01); *H01Q 21/061* (2013.01); *H01Q 21/22* (2013.01); *H01Q 1/246* (2013.01); *H01Q 3/36* (2013.01)

(58) Field of Classification Search
CPC ..... H01Q 11/08; H01Q 21/067; H01Q 1/362; H01Q 21/061; H01Q 11/083; H01Q 1/36; H01Q 25/00; H01Q 1/38; H01Q 1/523; H01Q 21/062; H01Q 25/002; H01Q 3/01; H01Q 5/40; H01Q 5/50; H01Q 9/285; H01Q 11/086; H01Q 1/40; H01Q 21/29; H01Q 25/02; H01Q 5/00; H01Q 5/357; H01Q 5/371; H01Q 9/14; H01Q 9/145;
(Continued)

(56) References Cited

U.S. PATENT DOCUMENTS 5,289,200 A * 2/1994 Kelly ..... H01Q 13/22 343/767
5,345,248 A * 9/1994 Hwang ..... H01Q 11/08 343/846
(Continued)

FOREIGN PATENT DOCUMENTS

CN 201336371 Y 10/2009
CN 203260740 U 10/2013
EP 0479507 A1 4/1992

OTHER PUBLICATIONS

Hao Wang et al., "Grating Lobe Reduction in a Phased Array of Limited Scanning", IEEE Transactions on antennas and production, Jun. 2008, vol. 56, No. 6, IEEE.
(Continued)

*Primary Examiner* — Tho G Phan
(74) *Attorney, Agent, or Firm* — Viering, Jentschura & Partner mbB

(57) ABSTRACT

The present disclosure relates to an antenna array arrangement including a plurality of antenna arrays. Each antenna array includes a plurality of antenna elements. At least two of the plurality of antenna arrays are staggered along at least one of a horizontal dimension or a vertical dimension. Adjacent elements of a projection of the antenna elements of the antenna array arrangement onto a horizontal dimension or a vertical dimension have a distance that is in the order of half of a wavelength of a radio signal to be transmitted from the antenna array arrangement.

25 Claims, 12 Drawing Sheets

(51) Int. Cl.

| | |
|---|---|
| ***H01Q 21/06*** | (2006.01) |
| ***H01Q 21/22*** | (2006.01) |
| *H01Q 3/36* | (2006.01) |
| *H01Q 1/24* | (2006.01) |

(58) Field of Classification Search
CPC ..... H01Q 9/27; H01Q 21/0006; H01Q 1/246; H01Q 21/22; H01Q 3/36
See application file for complete search history.

(56) References Cited

U.S. PATENT DOCUMENTS

| | | | | |
|---|---|---|---|---|
| 6,268,828 | B1 * | 7/2001 | Martek | H01Q 3/242 342/373 |
| 6,559,797 | B1 | 5/2003 | Chang | |
| 6,583,760 | B2 * | 6/2003 | Martek | H01Q 1/523 342/373 |
| 8,643,559 | B2 * | 2/2014 | Deng | H01Q 1/246 343/758 |
| 2008/0309568 | A1 | 12/2008 | Deng et al. | |

OTHER PUBLICATIONS

Georg Strauss et al., "A Circular Polarized TEM Horn Antenna Array with Large Scanning Angle", RWS, 2011, pp. 98-101, IEEE.
The Extended European Search Report based on Application No. 17169715.4 (9 Pages) dated Oct. 20, 2017 (Reference Purpose Only).
Chinese Office Action issued for corresponding application No. 201710306930.3, dated Nov. 4, 2019, 10 pages (for informational purpose only).

* cited by examiner

ARRAY ANTENNA ARRANGEMENT

TECHNICAL FIELD

Various aspects of this disclosure relate generally to an array antenna arrangement.

BACKGROUND

A conventional antenna array is a set of individual antennas used for transmitting and/or receiving radio waves, connected together in such a way that their individual currents are in a specified amplitude and phase relationship. The interactions of the different phases enhances the signal in one desired direction at the expense of other directions. This allows the array to act as a single antenna, generally with improved directional characteristics than would be obtained from the individual elements. A steerable array may be fixed physically but has electronic control over the relationship between those currents, allowing for adjustment of the antenna's directionality known as phased array antenna.

Hence, a phased array is an array of antennas in which the relative phases of the respective signals feeding the antennas are set in such a way that the effective radiation pattern if the array is reinforced in a desired direction and suppressed in undesired directions. In millimeter wave communications it is very important and necessary to compensate the high path loss by using a high gain antenna. A phase array antenna is expected to be a good candidate for 5G mmWave communications in order to achieve low cost and steerability.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
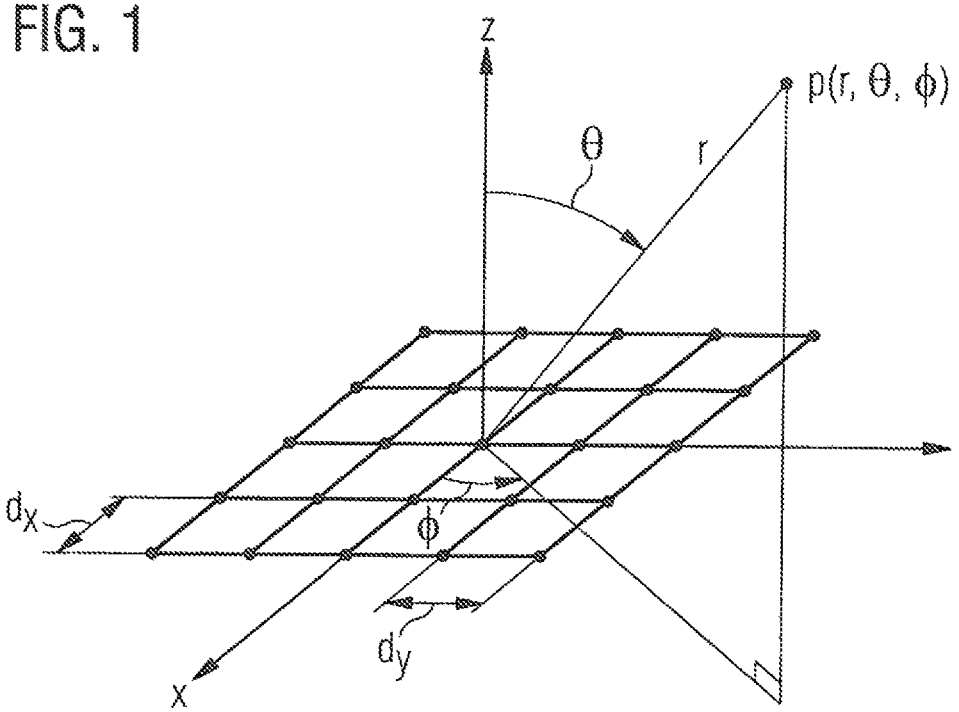
FIG. 1 shows an exemplary phase array antenna.

The following details description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The words "plural" and "multiple" in the description and the claims, if any, are used to expressly refer to a quantity greater than one. Accordingly, any phrases explicitly invoking the aforementioned words (e.g. "a plurality of [objects]", "multiple [objects]") referring to a quantity of objects is intended to expressly refer more than one of the said objects. The terms "group", "set", "collection", "series", "sequence", "grouping", "selection", etc., and the like in the description and in the claims, if any, are used to refer to a quantity equal to or greater than one, i.e. one or more. Accordingly, the phrases "a group of [objects]", "a set of [objects]", "a collection of [objects]", "a series of [objects]", "a sequence of [objects]", "a grouping of [objects]", "a selection of [objects]", "[object] group", "[object] set", "[object] collection", "[object] series", "[object] sequence", "[object] grouping", "[object] selection", etc., used herein in relation to a quantity of objects is intended to refer to a quantity of one or more of said objects. It is appreciated that unless directly referred to with an explicitly stated plural quantity (e.g. "two [objects]" "three of the [objects]", "ten or more [objects]", "at least four [objects]", etc.) or express use of the words "plural", "multiple", or similar phrases, references to quantities of objects are intended to refer to one or more of said objects.

As used herein, a "circuit" may be understood as any kind of a logic implementing entity, which may be special purpose circuitry or a processor executing software stored in a memory, firmware, and any combination thereof. Furthermore, a "circuit" may be a hard-wired logic circuit or a programmable logic circuit such as a programmable processor, for example a microprocessor (for example a Complex Instruction Set Computer (CISC) processor or a Reduced Instruction Set Computer (RISC) processor). A "circuit" may also be a processor executing software, e.g., any kind of computer program, for example, a computer program using a virtual machine code, e.g., Java. Any other kind of implementation of the respective functions which will be described in more detail below may also be understood as a "circuit". It may also be understood that any two (or more) of the described circuits may be combined into one circuit.

A "processing circuit" (or equivalently "processing circuitry") as used herein is understood as referring to any circuit that performs an operation(s) on signal(s), such as e.g. any circuit that performs processing on an electrical signal or an optical signal. A processing circuit may thus refer to any analog or digital circuitry that alters a characteristic or property of an electrical or optical signal, which may include analog and/or digital data. A processing circuit may thus refer to an analog circuit (explicitly referred to as "analog processing circuit(ry)"), digital circuit (explicitly referred to as "digital processing circuit(ry)"), logic circuit, processor, microprocessor, Central Processing Unit (CPU), Graphics Processing Unit (GPU), Digital Signal Processor (DSP), Field Programmable Gate Array (FPGA), integrated circuit, Application Specific Integrated Circuit (ASIC), etc., or any combination thereof. Accordingly, a processing circuit may refer to a circuit that performs processing on an electrical or optical signal as hardware or as software, such as software executed on hardware (e.g. a processor or microprocessor). As utilized herein, "digital processing circuit(ry)" may refer to a circuit implemented using digital logic that performs processing on a signal, e.g. an electrical or optical signal, which may include logic circuit(s), processor(s), scalar processor(s), vector processor(s), microprocessor(s), controller(s), microcontroller(s), Central Processing Unit(s) (CPU), Graphics Processing Unit(s) (GPU), Digital Signal Processor(s) (DSP), Field Programmable Gate Array(s) (FPGA), integrated circuit(s), Application Specific Integrated Circuit(s) (ASIC), or any combination thereof. Furthermore, it is understood that a single a processing circuit may be equivalently split into two separate processing circuits, and conversely that two separate processing circuits may be combined into a single equivalent processing circuit.

As used herein, "memory" may be understood as an electrical component in which data or information can be stored for retrieval. References to "memory" included herein may thus be understood as referring to volatile or non-volatile memory, including random access memory (RAM), read-only memory (ROM), flash memory, solid-state storage, magnetic tape, hard disk drive, optical drive, etc., or any combination thereof. Furthermore, it is appreciated that registers, shift registers, processor registers, data buffers, etc., are also embraced herein by the "term" memory. It is appreciated that a single component referred to as "memory" or "a memory" may be composed of more than one different type of memory, and thus may refer to a collective component including one or more types of memory. It is readily understood that any single memory "component" may be distributed or/separated multiple substantially equivalent memory components, and vice versa. Furthermore, it is appreciated that while "memory" may be depicted, such as in the drawings, as separate from one or more other components, it is understood that memory may be integrated within another component, such as on a common integrated chip.

As used herein, a "cell", in the context of telecommunications, may be understood as a sector served by a base station. Accordingly, a cell may be a set of geographically co-located antennas that correspond to a particular sector of a base station. A base station may thus serve one or more "cells" (or "sectors"), where each cell is characterized by a distinct communication channel. An "inter-cell handover" may be understood as a handover from a first "cell" to a second "cell", where the first "cell" is different from the second "cell". "Inter-cell handovers" may be characterized as either "inter-base station handovers" or "intra-base station handovers". "Inter-base station handovers" may be understood as a handover from a first "cell" to a second "cell", where the first "cell" is provided at a first base station and the second "cell" is provided at a second, different, base station. "Intra-base station handovers" may be understood as a handover from a first "cell" to a second "cell", where the first "cell" is provided at the same base station as the second "cell". A "serving cell" may be understood as a "cell" that a mobile terminal is currently connected to according to the mobile communications protocols of the associated mobile communications network standard. Furthermore, the term "cell" may be utilized to refer to any of a macrocell, microcell, picocell, or femtocell, etc.

The term "base station", used in reference to an access point of a mobile communications network, may be understood as a macro-base station, micro-base station, Node B, evolved Node B (eNodeB, eNB), Home eNodeB, Remote Radio Head (RRH), or relay point, etc.

It is to be noted the ensuing description discusses utilization of the mobile communications device under 3GPP (Third Generation Partnership Project) specifications, notably Long Term Evolution (LTE), Long Term Evolution-Advanced (LTE-A), and/or 5G. It is understood that such exemplary scenarios are demonstrative in nature, and accordingly may be similarly applied to other mobile communication technologies and standards, such as WLAN (wireless local area network), WiFi, UMTS (Universal Mobile Telecommunications System), GSM (Global System for Mobile Communications), Bluetooth, CDMA (Code Division Multiple Access), Wideband CDMA (W-CDMA), etc. The examples provided herein are thus understood as being applicable to various other mobile communication technologies, both existing and not yet formulated, particularly in cases where such mobile communication technologies share similar features as disclosed regarding the following examples.

The term "network" as utilized herein, e.g. in reference to a communication network such as a mobile communication network, is intended to encompass both an access component of a network (e.g. a radio access network (RAN) component) and a core component of a network (e.g. a core network component).

FIG. 1 shows an exemplary planar antenna array 100 having 5×5 antenna elements that are equally spaced apart in the x-y plane. A point of a radiation pattern of the antenna array can be described by its distance from the origin r, its azimuth angle $\varphi$ and its elevation angle $\theta$. The azimuth angle $\varphi$ is the angle between the x-axis and the projection of the vector pointing from the origin to the point $p(r, \theta, \varphi)$ onto the x-y plane. The elevation angle $\theta$ is the angle between the z-axis and the vector pointing to the $p(r, \theta, \varphi)$. Planar antenna arrays may be employed in cellular communication networks for example.

Figure 2:
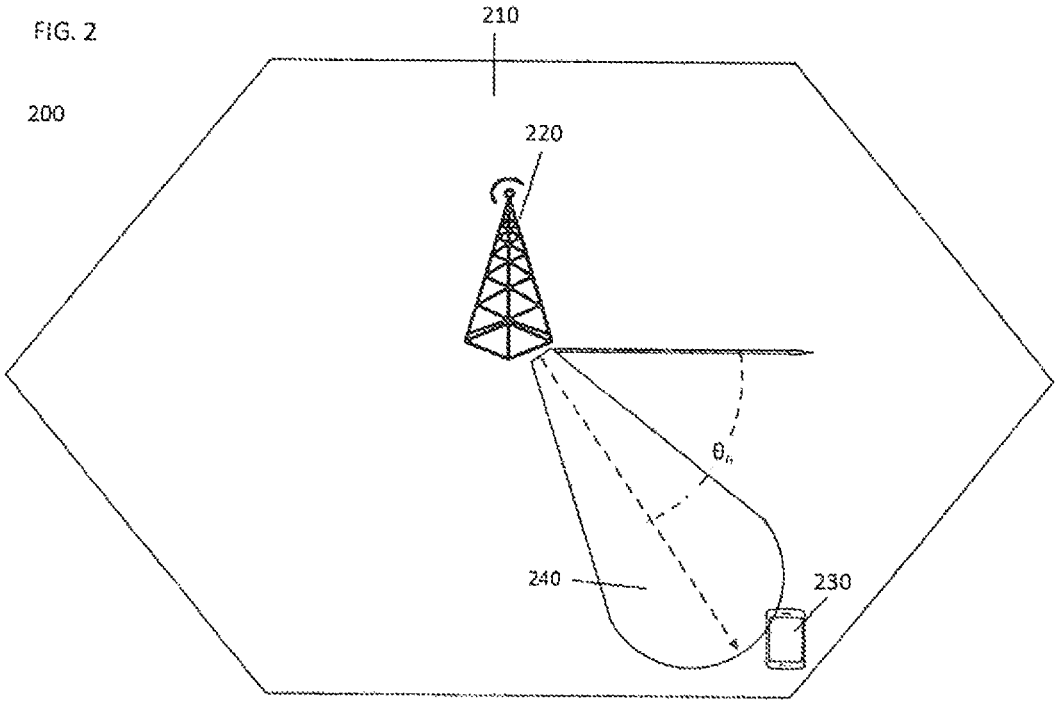
FIG. 2 shows an exemplary communication network in an aspect of this disclosure.

FIG. 2 shows a communication network 200 in an aspect of this disclosure. It is appreciated that communication network 200 is exemplary in nature and thus may be simplified for purposes of this explanation. Communications Network 200 may be configured in accordance with the network architecture of any one of, or any combination of, 5G, LTE (Long Term Evolution), WLAN (wireless local area network), WiFi, UMTS (Universal Mobile Telecommunications System), GSM (Global System for Mobile Communications), Bluetooth, CDMA (Code Division Multiple Access), Wideband CDMA (W-CDMA) etc.

Communication network 200 may include at least a base station 220 with a corresponding cover region, or cell, 210. Base station 220 may be a base station with the capability of millimeter wave (mmWave) communication. Base station 220 may direct a beam 240 towards a mobile device 230 having a beam direction as indicated by the dotted arrow to compensate the path loss of mmWave using a high gain phased array antenna.

Because of the high loss of radio frequency feed line at high frequency used to feed the antenna elements of phased array antenna, it is required to limit the length of the feed line, otherwise feed line loss may be higher than what can be gained from antenna beamforming. Hence, designing a large array using a single radio frequency integrated chip (RFIC) may be suboptimal. However, multiple RFICs based on a modular antenna array (MAA) may be employed to achieve the same antenna gain as with antenna beamforming for a single array. Moreover, MAA provides configuration flexibility at comparably low cost.

MAA is a flexible architecture in which assembles multiple antenna modules in a pre-defined way to achieve a desired antenna pattern and antenna gain. In contrast to a single large array in which multiple RFICs and antennae are mounted on a single printed circuit board (PCB), MAA is more flexible to employ multiple radio modules. Each radio module may include a plurality of antenna elements and a single RFIC. Different antenna geometries can be employed to MAA to achieve target side lobe suppression and desired beam width.

Figure 3:
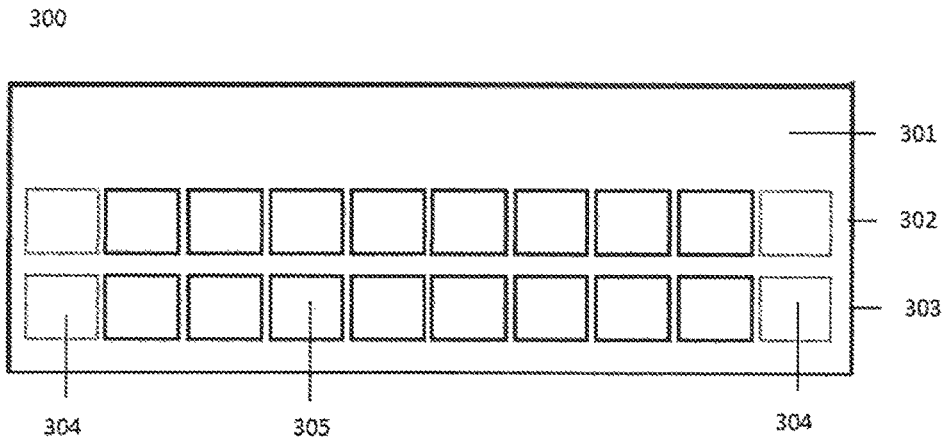
FIG. 3 shows an exemplary antenna module in an aspect of this disclosure.

FIG. 3 shows an exemplary single radio module 300 including a first row of antenna elements 302 and a second row of antenna elements 303 which are assembled on a printed circuit board 301. The exemplary radio module 300 has total number of 20 antenna elements forming a planar antenna array. The planar antenna array includes antenna elements 305 used for beamforming. It may also include omni elements 304 (shaded) at the edges which are not used for beamforming. These elements 304 may be dummy elements. The antenna elements may be equally spaced apart along the horizontal dimension and the vertical dimension. The distance between adjacent antenna elements may be in the order of a half of a wavelength of a signal that is to be transmitted from the antenna array to prevent grating lobes of the resulting antenna pattern. The single radio module may also include a RFIC.

Figure 4:
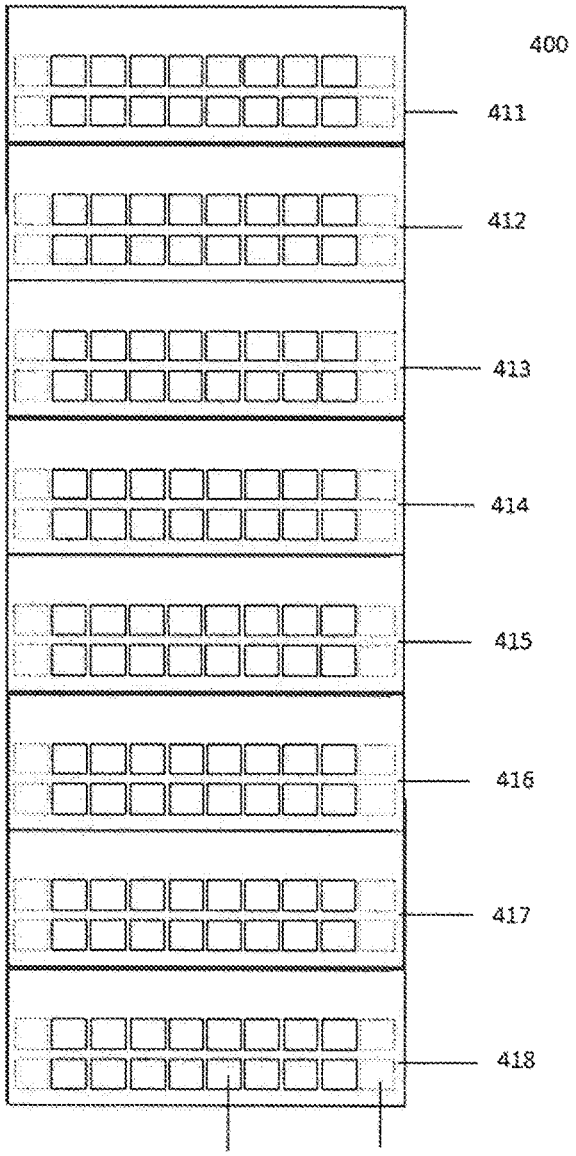
FIG. 4 shows an exemplary modular antenna array in an aspect of this disclosure.

FIG. 4 shows an exemplary MAA 400 including a plurality of radio modules 411-418, each radio module including antenna elements 402 used for beam steering and dummy antenna elements 403 at the edges.

The design of geometry for a MAA is critical. Non-careful design may introduce grating lobes in the antenna pattern which may cause strong interference to nearby peers. An equal antenna spacing which is roughly half of the wavelength of a radio signal to be transmitted from the MAA may prevent grating lobes.

Figure 6:
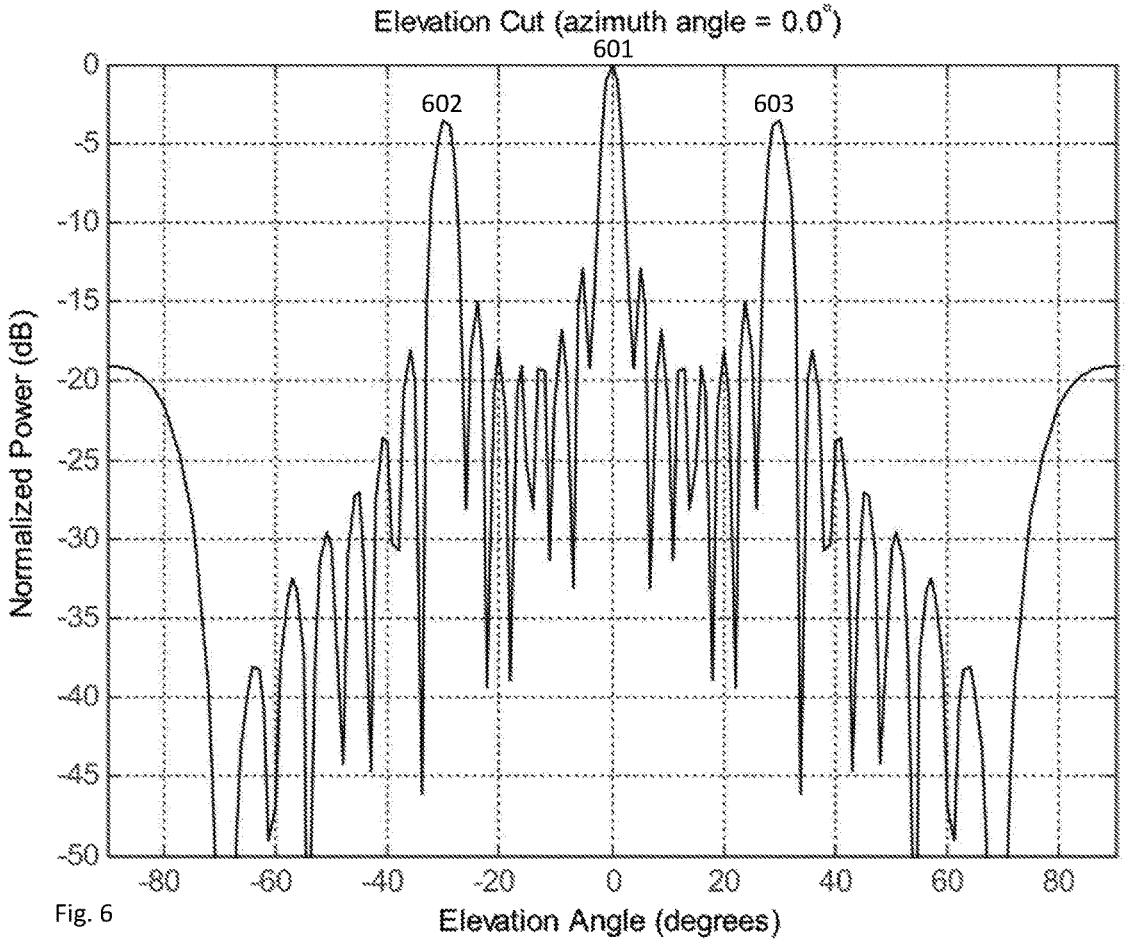
FIG. 6 shows an elevation cut of the antenna pattern of the exemplary modular antenna as shown in FIG. 4 in an aspect of this disclosure.

However, due to RFIC chip size and the size of an individual radio an equal spacing on a two-dimensional domain, i.e. azimuth and elevation may not be obtained as can be observed for the MAA as shown in FIG. 4 where there is gap between the lower row of antenna elements of a radio module and the upper row of a preceding lower radio module. When all antenna elements of the MAA are projected onto the vertical domain, i.e. the y-axis, those gaps will also occur on the vertical projection. The vertical projection can be regarded as a virtual linear antenna array along the vertical dimension that has a non-equidistant antenna element spacing with gaps much larger than half of a wavelength of the signal to be transmitted from the MAA. This may result in grating lobes in the elevation cut of the antenna pattern as shown in FIG. 6 where two gratings lobes 602, 603 can be observed at −30° and 30° that differ from the main lobe 601 by less than 5 dB.

Figure 5:
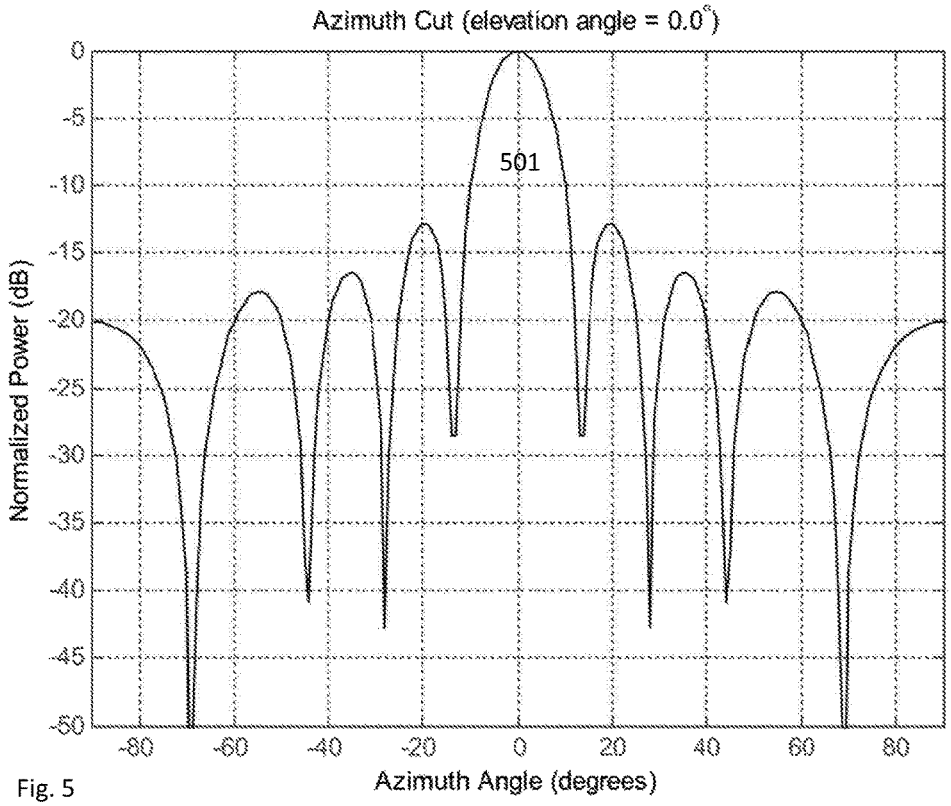
FIG. 5 shows an azimuth cut of the antenna pattern of the exemplary modular antenna as shown in FIG. 4 in an aspect of this disclosure.

Now referring back to FIG. 4, a horizontal projection of the MAA can be regarded as a virtual linear antenna array along the horizontal dimension. The virtual linear antenna along the horizontal dimension has an equidistant antenna element spacing and does not have any gaps. Hence, grating lobes in the azimuth cut of the antenna pattern of the MAA are not be expected as shown in FIG. 5 where no grating lobes occur around the main lobe 501.

In a similar way, if the radio modules of the MAA as shown in FIG. 4 were arranged side by side horizontally, grating lobes are expected to be in the azimuth cut of the antenna pattern.

Figure 7:
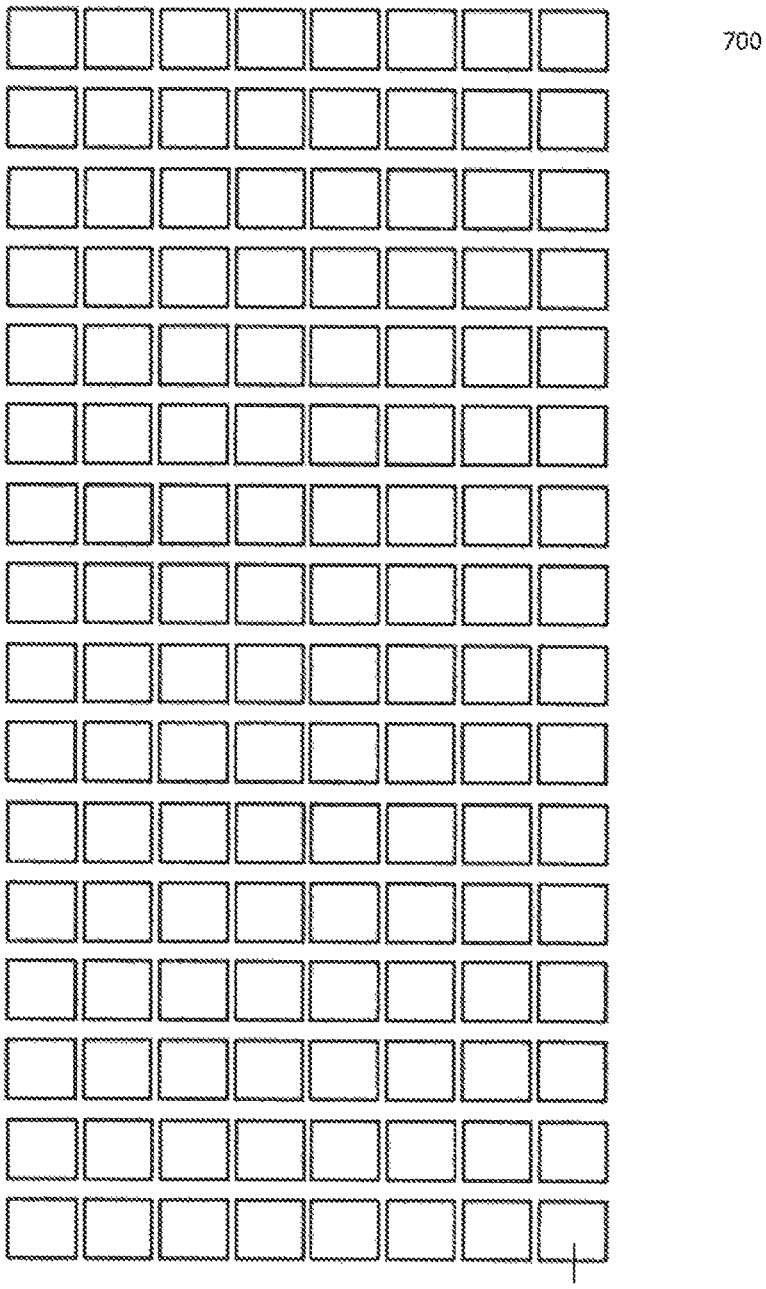
FIG. 7 shows an exemplary design of a large antenna array in an aspect of this disclosure.
Figure 8:
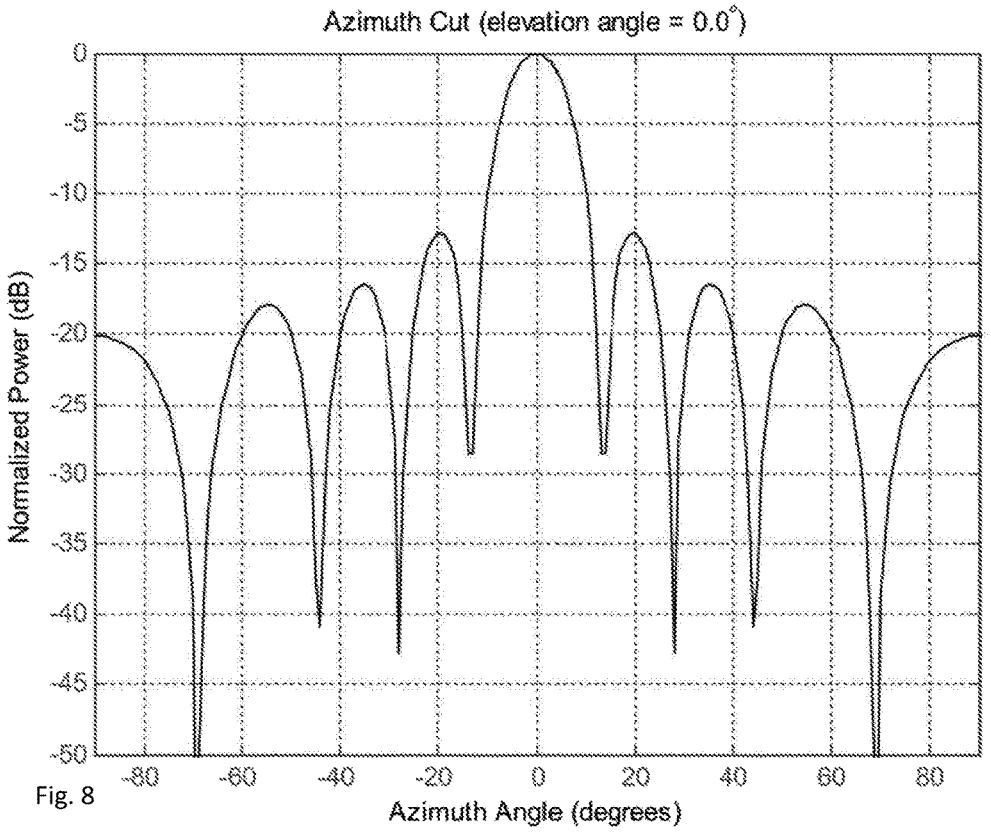
FIG. 8 shows an azimuth cut of the antenna pattern of the large antenna as shown in FIG. 7 in an aspect of this disclosure.
Figure 9:
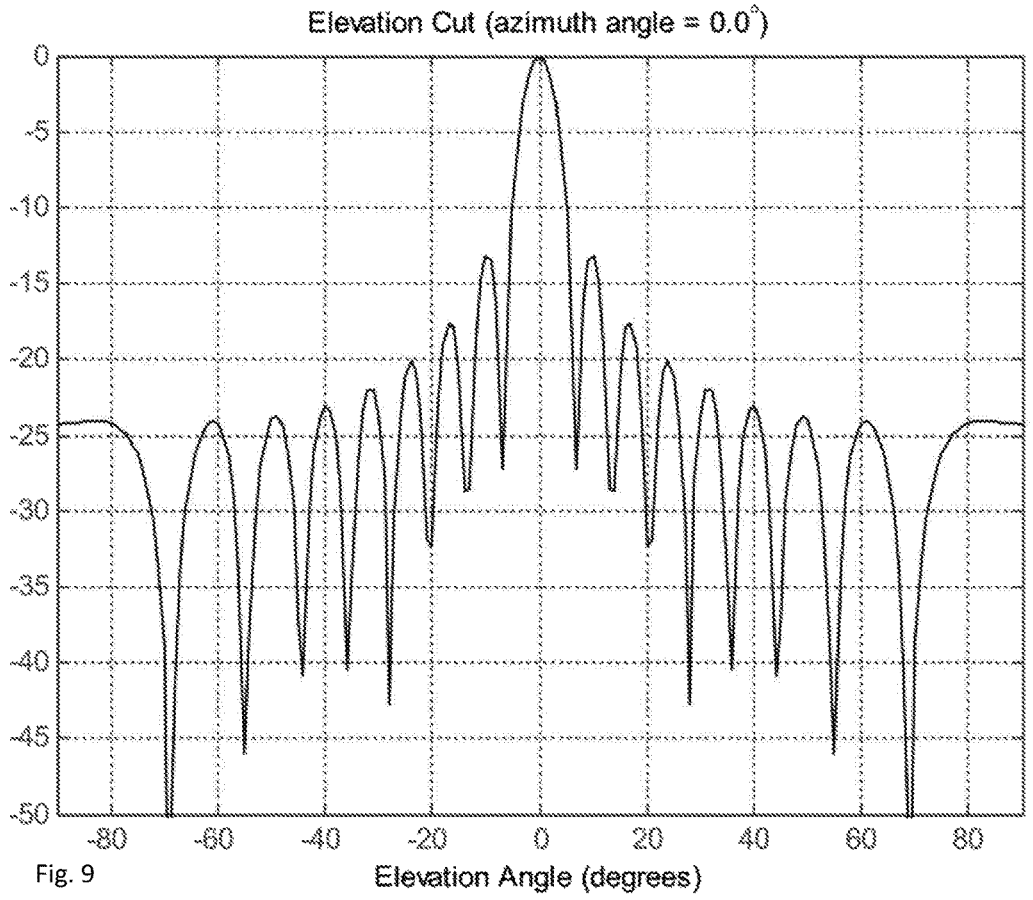
FIG. 9 shows an elevation cut of the antenna pattern of the large antenna as shown in FIG. 7 in an aspect of this disclosure.

FIG. 7 shows an exemplary large linear array 700 including a plurality of antenna elements 701 that are mounted on a single PCB. 8 RFICs are mounted on the back of the PCB. Even though neither the azimuth cut of the antenna pattern as shown in FIG. 8 nor the elevation cut of the antenna pattern as shown in FIG. 9 does have any grating lobes, the large linear array 700 may require complete redesign making it expensive compared to the MAA as shown in FIG. 4 where off-the-shelve radio modules can be employed. As with single PCB design existing radio modules cannot be employed, it may add cost and design complexity to a company and may also delay the product shipping schedule.

Hence, there is a need to provide a large antenna array that allows employing existing radio modules to form a modular antenna array with reduced grating lobes compared to conventional MAAs.

Figure 10:
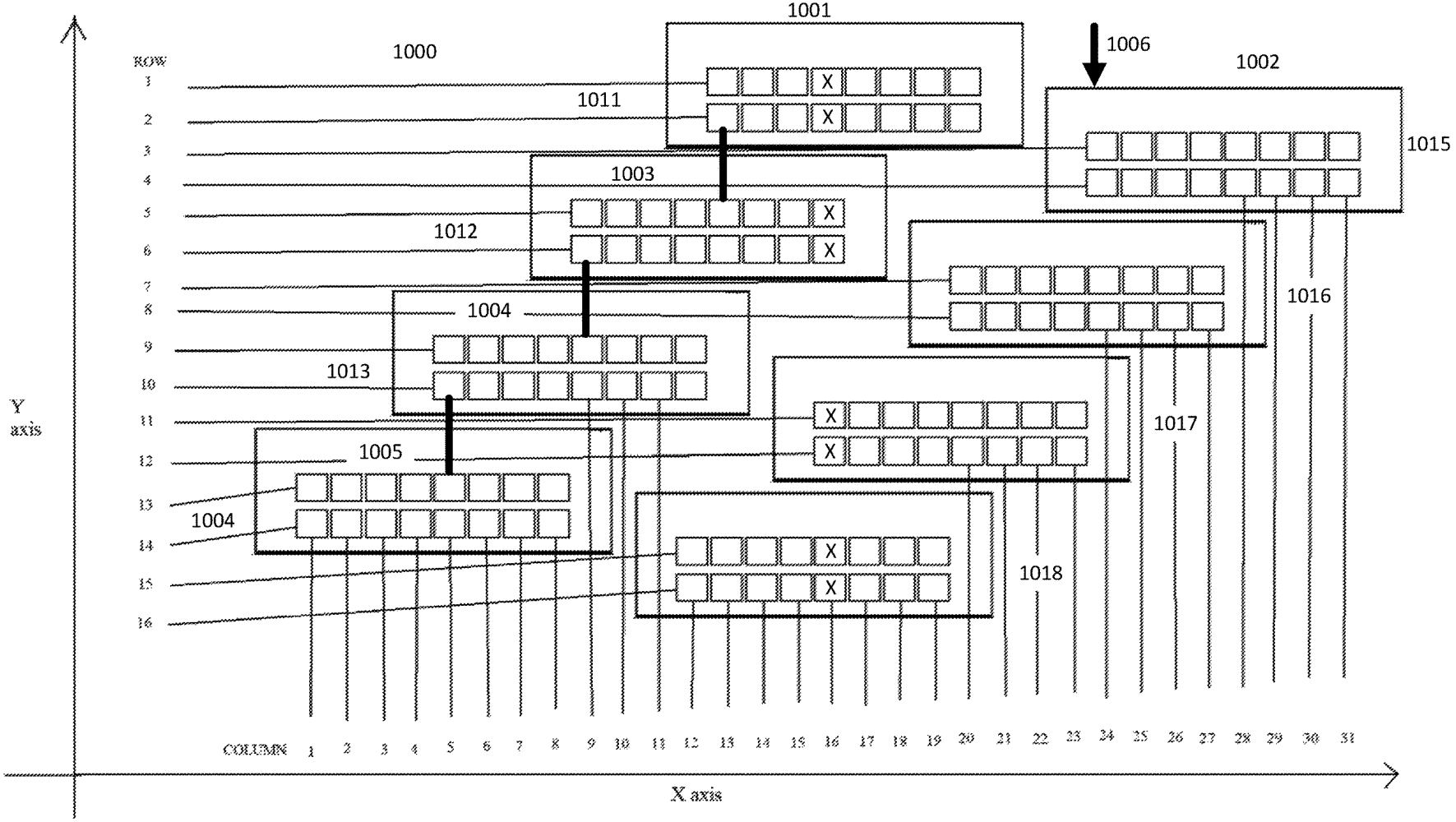
FIG. 10 shows an exemplary design of a modular antenna array arrangement in an aspect of this disclosure.

FIG. 10 shows an exemplary antenna array arrangement 1000, i.e. an MAA, including a plurality of antenna arrays 1011-1018. Each antenna array may be mounted on a single PCB and may be controlled by a separate RFIC. It can be observed that at least two of the plurality of antenna arrays are staggered along at least one of a horizontal dimension, i.e. the x-axis, or the vertical dimension, i.e. the y-axis. For example, antenna arrays 1011 and 1012 are staggered along the horizontal dimension. Adjacent elements of a projection of the antenna elements of the antenna array arrangement onto a horizontal dimension or a vertical dimension may have a distance that is in the order of half of a wavelength of a radio signal to be transmitted from the antenna array arrangement which will be explained later in more detail with reference to FIG. 11 and FIG. 12. The distance may be less than or equal to half of a wavelength of a radio signal to be transmitted from the antenna array arrangement. The distance may be less than 125% of a wavelength of a radio signal to be transmitted from the antenna array.

In this example, the antenna arrays are arranged in two sets 1001 and 1002. Set 1001 includes antenna arrays 1011-1014 and set 1002 includes antenna arrays 1015-1018. The two sets may be arranged in parallel with an offset along the vertical dimension as shown.

In the arrangement all antenna arrays within a set of antenna arrays are staggered along the horizontal dimension. For example, antenna arrays 1011, 1012, 1013 and 1014 of the first set 1001 are staggered along the horizontal dimension. Antenna arrays 1015, 1016, 1017 and 1018 of the second set 1012 are also staggered along the horizontal dimension.

Note, within a set of antenna arrays, that there is a gap between the lower antenna element row of an antenna array and the upper antenna element row of the adjacent antenna array along the vertical dimension that is larger than the distance between the upper and lower antenna element row within an antenna array. As the distance between adjacent antenna elements within an antenna array may be designed roughly to be half of a wavelength of a signal to be transmitted, the gap may be much larger than half of wavelength. For example, there is a gap 1003 between the lower antenna element row of antenna array 1011 and the upper antenna element row of antenna array 1012. Within the first set 1001 the gap also occurs between adjacent antenna arrays 1012 and 1013, i.e. gap 1004, and adjacent antenna arrays 1013 and 1014, i.e. gap 1005.

If only the first set of antenna arrays 1001 was projected onto the vertical dimension, the gaps would also occur on the vertical projection. The vertical projection can be thought of as a virtual linear array having a non-equidistant number of antenna elements. Hence, grating lobes can be expected to occur in an elevation cut of the antenna pattern if only the first set of antenna arrays 1001 was employed for transmitting a signal.

Figure 11:
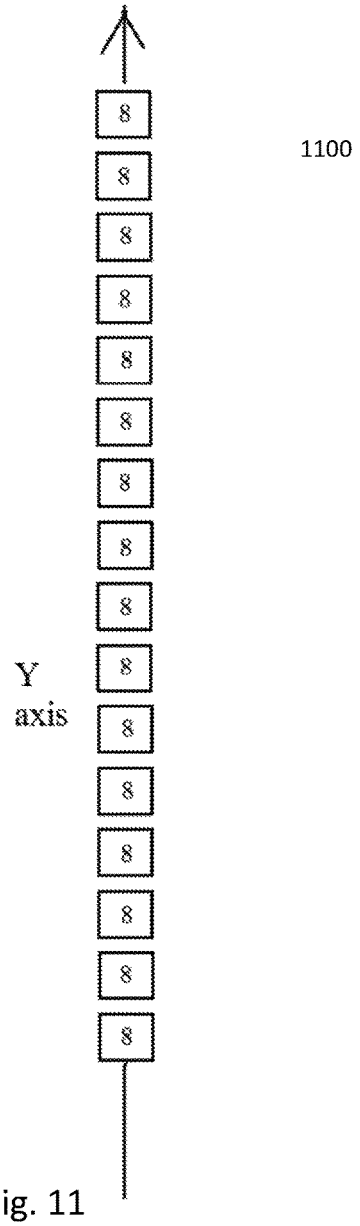
FIG. 11 shows a projection of antenna elements of the modular antenna array arrangement onto the vertical domain in an aspect of this disclosure.

The gaps occurring in the vertical projection can be removed by the arrangement of the second set of antenna arrays 1002. The vertical projection is shown in FIG. 11. The vertical projection includes a plurality of projection elements. The number inside each projection element indicates the number of antenna elements of the antenna array arrangement that were projected onto each projection element. For the exemplary arrangement as shown in FIG. 10, this number is 8. Hence, 8 antenna elements were projected onto each projection element. It can be observed that the adjacent projection elements may be equidistant. However, it is important to note that the projection elements do not need to be exactly equidistant as long as the distance between adjacent projection elements is in the order of half of a wavelength of the signal to be transmitted. Moreover, the distance between two adjacent projection elements may be the same as the distance between the upper antenna element row and the lower antenna element row within an antenna array.

Figure 14:
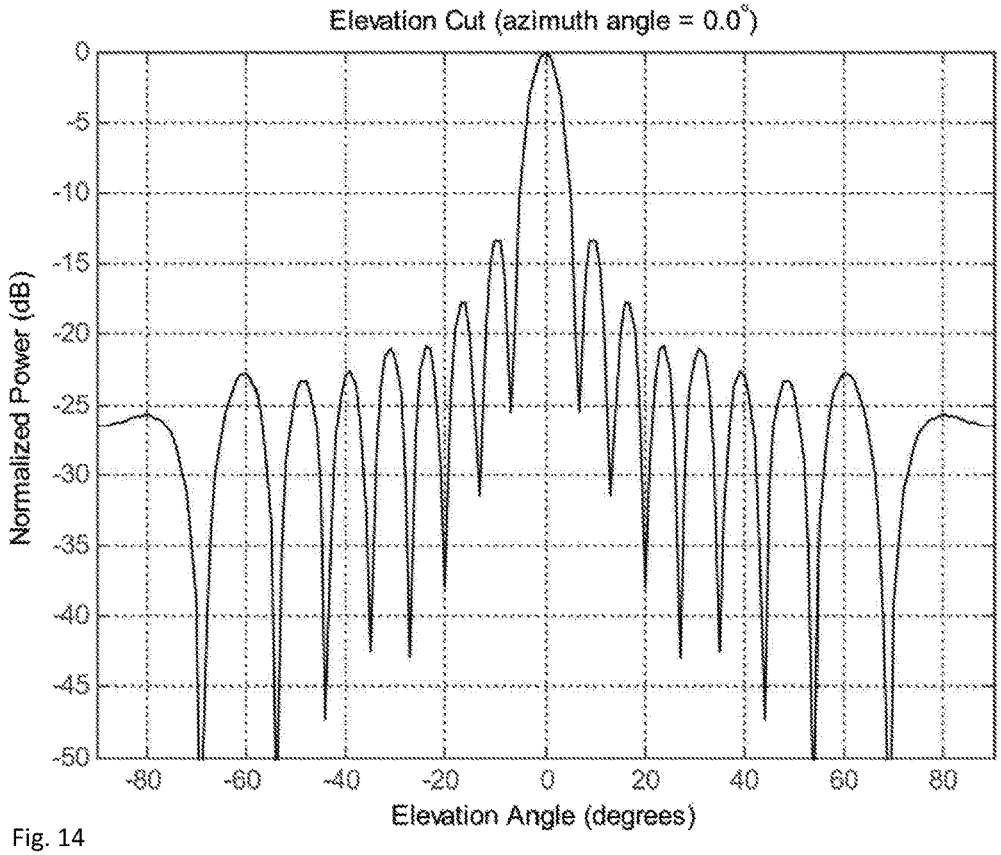
FIG. 14 shows an elevation cut of the antenna pattern of the exemplary modular antenna array arrangement as shown in FIG. 12.

The projection onto the vertical dimension can be thought as a linear antenna array. As the antenna elements of this array are equidistant and may have a distance that is in the order of half of wavelength of a signal to be transmitted an elevation cut of the antenna pattern can be expected in which grating lobes may not occur. In this example, the elevation cut pattern is the same as a regular uniform 16 element antenna array. FIG. 14 shows the elevation cut of the antenna pattern of the antenna array arrangement as shown in FIG. 10 which does not show any grating lobes.

Now referring back to FIG. 10, if only the first set of antenna arrays 1001 was projected onto the horizontal dimension, the resulting horizontal projection would have no gaps as the individual antenna arrays have an offset along the horizontal dimension so that the antenna elements are aligned along the vertical dimension. Hence, grating lobes in the azimuth cut of the elevation pattern are not be expected.

Figure 12:
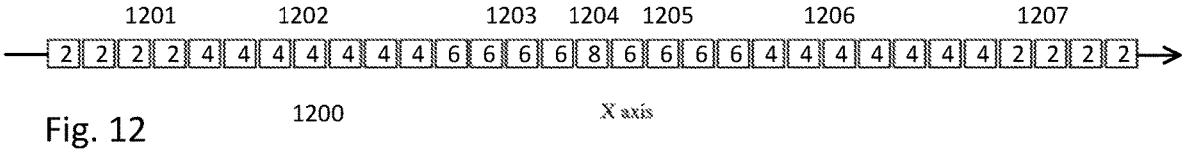
FIG. 12 shows a projection of antenna elements of the modular antenna array arrangement onto the horizontal domain in an aspect of this disclosure.

FIG. 12 shows a projection of the antenna array arrangement as shown in FIG. 10 onto the horizontal dimension. The horizontal projection includes a plurality of projection elements. The projection elements may be equidistant as shown. It is important to note that projection elements do not need to be exactly equidistant as long as the distance between adjacent projection elements is in the order of half of a wavelength of the signal to be transmitted. Moreover, the distance between two adjacent projection elements may be the same as the distance between adjacent antenna elements within an antenna array due to the chosen arrangement.

Figure 13:
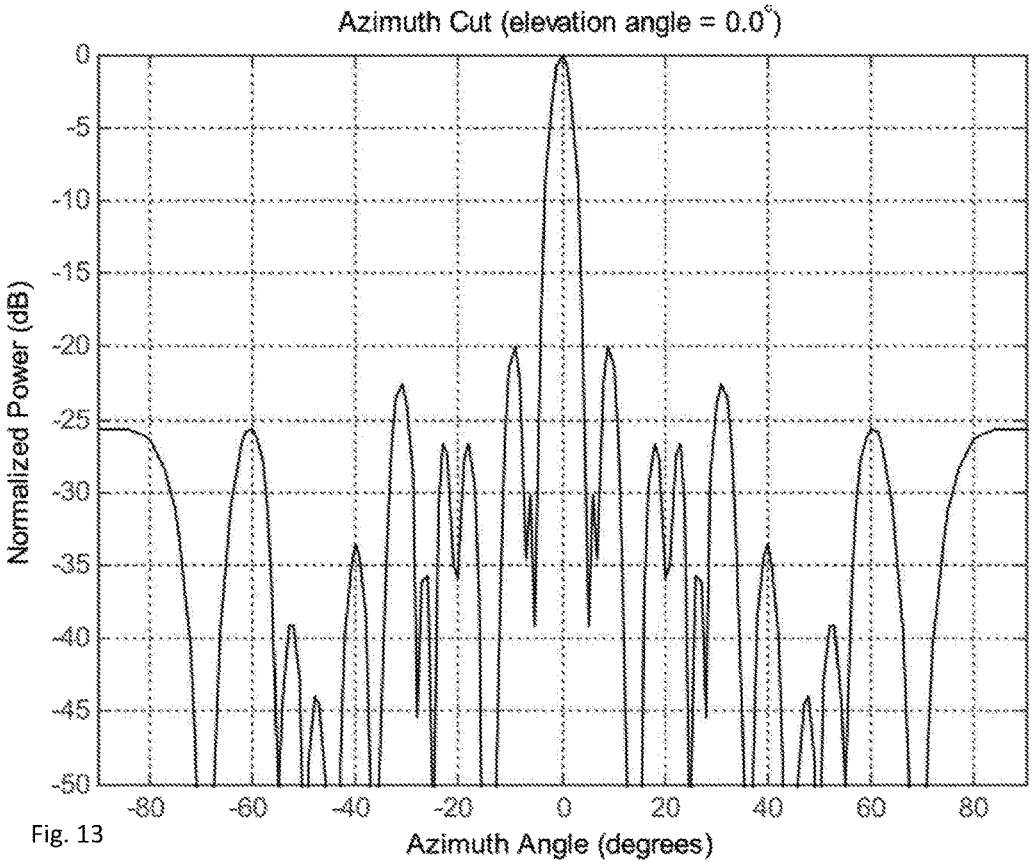
FIG. 13 shows an azimuth cut of the antenna pattern of the exemplary modular antenna array arrangement as shown in FIG. 12 in an aspect of this disclosure.

The projection onto the horizontal dimension can be thought of as a linear antenna array. As the antenna elements of this array are equidistant and may have a distance that is in the order of half of wavelength of a signal to be transmitted, an azimuth cut of the antenna pattern can be expected in which grating lobes do not occur. FIG. 13 shows the azimuth cut of the antenna pattern of the antenna array arrangement as shown in FIG. 10 which does not show any grating lobes.

The number inside each projection element indicates the number of antenna elements of the antenna array arrangement that were projected onto each projection element. It can be observed that the projection of the antenna array arrangement onto the horizontal dimension includes a first end portion including projection elements 1201, a second end portion including projection elements 1207 and a middle portion including projection elements 1203, 1204 and 1205. The number of antenna elements projected onto each element of the middle portion, in this example 6 and 8, is larger than a number of antenna elements projected onto each element of the first end portion and the second end, in this example 2.

The distribution of the number of projected antenna elements is an application of the amplitude tapering theory. As the number in the middle portion is higher than the number in an end portion, the energy of the antenna array arrangement is concentrated its center. Hence, an even further suppression of the side lobes can be achieved. It is important to note that amplitude tapering theory can be applied in either dimension by a proper design of the antenna array arrangement. It can also be applied to both dimensions.

The projection of the antenna array arrangement onto the horizontal dimension may be symmetric and centered around its middle portion. A center element of the projection of the antenna array arrangement onto the horizontal dimension, e.g. center element 1204 in FIG. 12, may have a number of projected antenna elements that is equal to the number of projected antenna elements onto each element of the projection of the antenna array arrangement onto the vertical dimension, which is 8 in this example.

Alternatively, each element of the projection of the antenna array arrangement onto the horizontal dimension may include an equal number of projected antenna elements. The projection of the antenna array arrangement onto the vertical dimension may be symmetrical and centered around its middle portion. A center element of the projection of the projection of the antenna array arrangement onto the vertical dimension having a number of projected antenna elements that is equal to the number of projected antenna elements onto each element of the projection of the antenna array arrangement onto the horizontal dimension.

Alternatively, the projection of the antenna array arrangement onto the vertical dimension as well as onto the horizontal dimension may be symmetrical and centered around its middle portion. In this way amplitude tapering theory can be applied in both dimension.

Referring again to FIG. 12, it can be observed that the projection of the antenna array arrangement onto the horizontal dimension includes a decreasing number of projected antenna elements towards its first end portion 1201 and its second end portion 1207. The number of projected antenna elements decreases from 8 to 2 in this example.

Referring back to FIG. 10, in order to apply amplitude theory properly, it can be observed that the two sets of staggered antenna arrays 1001 and 1002 are arranged parallel to each other and have an offset along the vertical dimension. Furthermore, antenna elements of an antenna array of the first set of antenna arrays 1001, e.g. antenna elements of antenna arrays 1011 and 1012 indicated by the cross, are aligned with antenna elements of an antenna array of the second set of antenna arrays 1002, e.g. antenna elements of antenna arrays 1013 and 1014 indicated by the cross, along the vertical dimension. In this example, the projected antenna elements indicated by the cross are projected onto projection element 1204 of FIG. 12.

The antenna array arrangement as shown in FIG. 10 may be a modular antenna array. It thus may include a plurality of radio frequency integrated circuits. Each antenna array of the antenna arrays 1011-1018 may be controlled by a separate radio frequency integrated circuit (not shown).

Each antenna array of the antenna arrays 1011-1018 may be mounted on a separate printed circuit board.

Each antenna array of the antenna arrays 1011-1018 may include dummy antenna elements, i.e. antenna element due to manufacturing or antenna elements not used for beams forming.

The antenna array arrangement as shown in FIG. 10 has about a 7 dB better side lobe suppression on the azimuth cut of the antenna pattern and the same antenna pattern on the elevation cut when compared with a 16×8 uniform array as shown in FIG. 6, see FIG. 7 versus FIG. 13 for the azimuth cut and FIG. 8 versus FIG. 14 for the elevation cut.

The uniform antenna array as shown in FIG. 6 and the antenna array arrangement as shown in FIG. 10 have the same antenna gains, as the antenna gain is dependent on the number of elements and the number of RFICs, but is independent on the geometry.

Moreover, the uniform antenna array as shown in FIG. 6 and the antenna array arrangement as shown in FIG. 10 have the same steering range.

Hence, a better directivity can be achieved by the antenna array arrangement of the present disclosure compared to a modular array antenna as shown in FIG. 4 without sacrificing gain and steering range.

Figure 15:
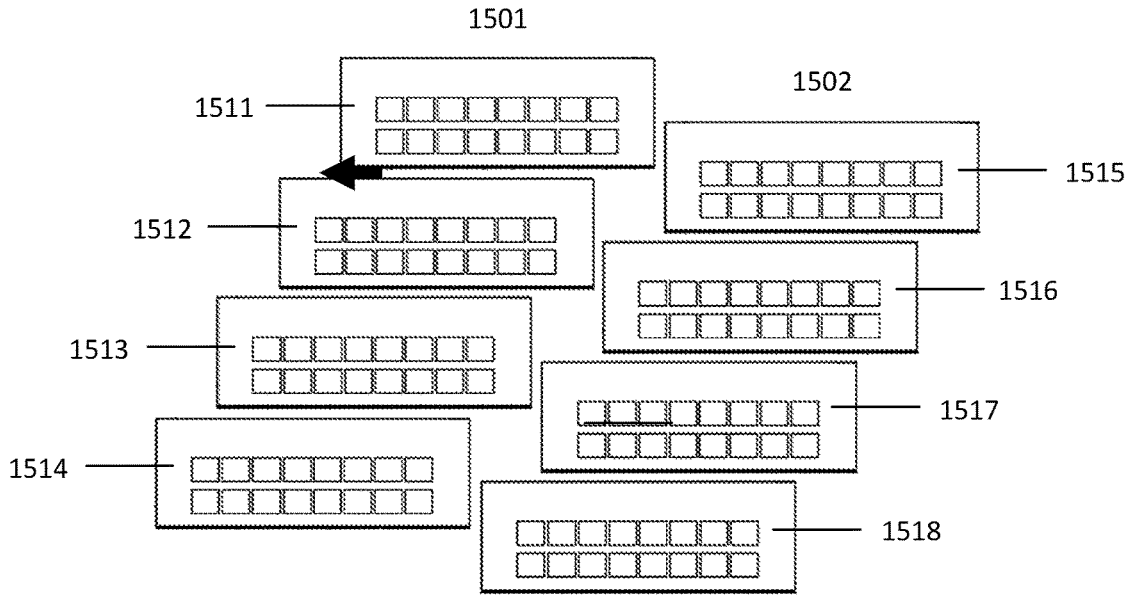
FIG. 15 shows another exemplary design of a modular antenna array arrangement in an aspect of this disclosure.

FIG. 15 shows an exemplary antenna array arrangement 1500, i.e. an MAA, including a plurality of antenna arrays 1511-1518. Each antenna array may be mounted on a single PCB and may be controlled by a separate RFIC. It can be observed that at least two of the plurality of antenna arrays are staggered along at least one of a horizontal dimension, i.e. the x-axis, or the vertical dimension, i.e. the y-axis. For example, antenna arrays 1511 and 1512 are staggered along the horizontal dimension.

In this example, the antenna arrays are also arranged in two sets 1501 and 1502. Set 1501 includes antenna arrays 1511-1514 and set 1502 includes antenna arrays 1515-1518. The two sets may be arranged in parallel with an offset along the vertical dimension as shown.

In the arrangement all antenna arrays within a set of antenna arrays are staggered along the horizontal dimension. For example, antenna arrays 1511, 1512, 1513 and 1514 of the first set 1501 are staggered along the horizontal dimension. Antenna arrays 1515, 1516, 1517 and 1518 of the second set 1512 are also staggered along the horizontal dimension.

Figure 16:
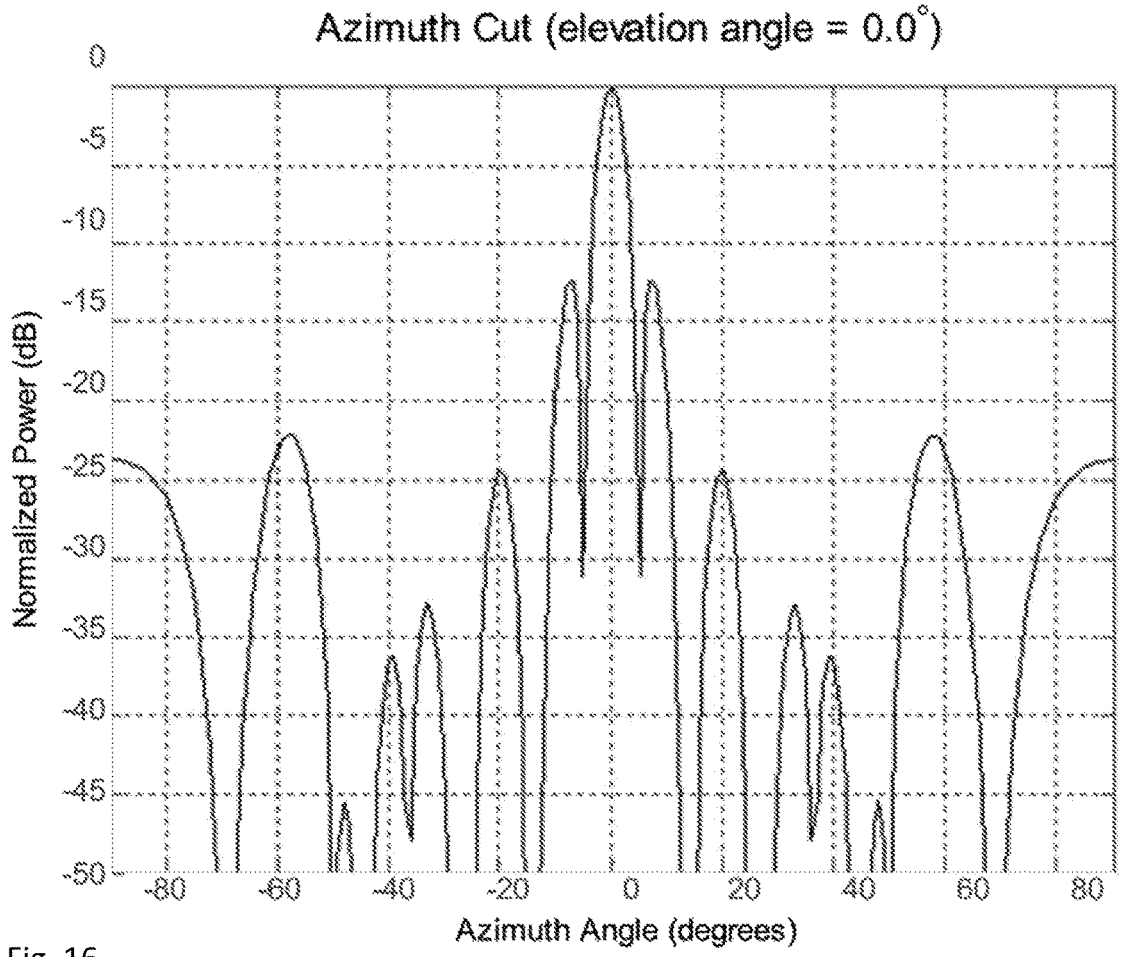
FIG. 16 shows an azimuth cut of the antenna pattern of the exemplary modular antenna array arrangement as shown in FIG. 15 in an aspect of this disclosure.

The arrangement in FIG. 15 is similar to the one shown in FIG. 10. However, within a set, two antenna arrays have an offset of two instead of four antenna elements along the horizontal dimension, e.g. antenna arrays 1511 and 1512 have an offset of two antenna elements as indicated by the arrow pointing to the left hand side. This results in a wider beam at a cost of less sidelobe suppression on the azimuth cut as shown in FIG. 16. Sidelobes are about 7 dB worse than those for the arrangement as shown in FIG. 10, see FIG. 16 versus FIG. 13. Hence, the design methodology is flexible.

Figure 17:
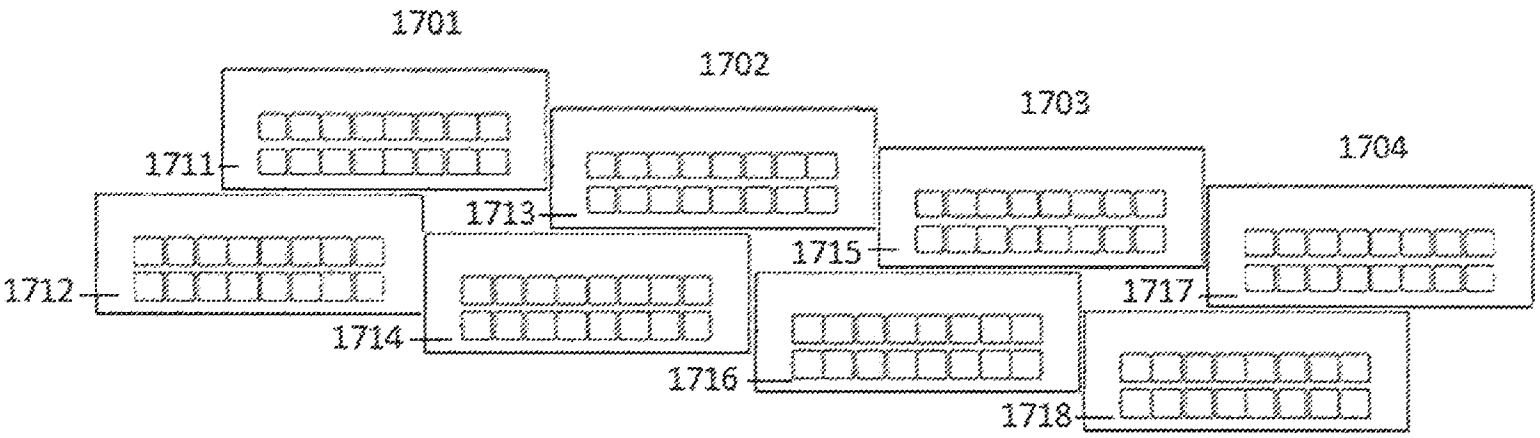
FIG. 17 shows another exemplary design of a modular antenna array arrangement in an aspect of this disclosure.

FIG. 17 shows an exemplary antenna array arrangement 1700, i.e. an MAA, including a plurality of antenna arrays 1711-1718. Each antenna array may be mounted on a single PCB and may be controlled by a separate RFIC. It can be observed that at least two of the plurality of antenna arrays are staggered along at least one of a horizontal dimension, i.e. the x-axis, or the vertical dimension, i.e. the y-axis In this example, the antenna arrays are also arranged in four sets 1701, 1702, 1703 and 1704. Set 1701 includes antenna arrays 1711-1712, set 1702 includes antenna arrays 1713-1714, set 1703 includes antenna arrays 1715-1716 and set 1704 includes antenna arrays 1717-1718. The four sets may be arranged in parallel with an offset along the horizontal dimension as shown.

In the arrangement the two antenna arrays within a set of antenna arrays are staggered along the horizontal dimension. For example, antenna arrays 1711 and 1712 of the first set 1701 are staggered along the horizontal dimension. A projection of the arrangement onto the horizontal dimension includes a maximum number of four antenna elements projected onto a projection element of the horizontal dimension but a maximum number of sixteen antenna elements projected onto a projection element of the vertical dimension.

Figure 18:
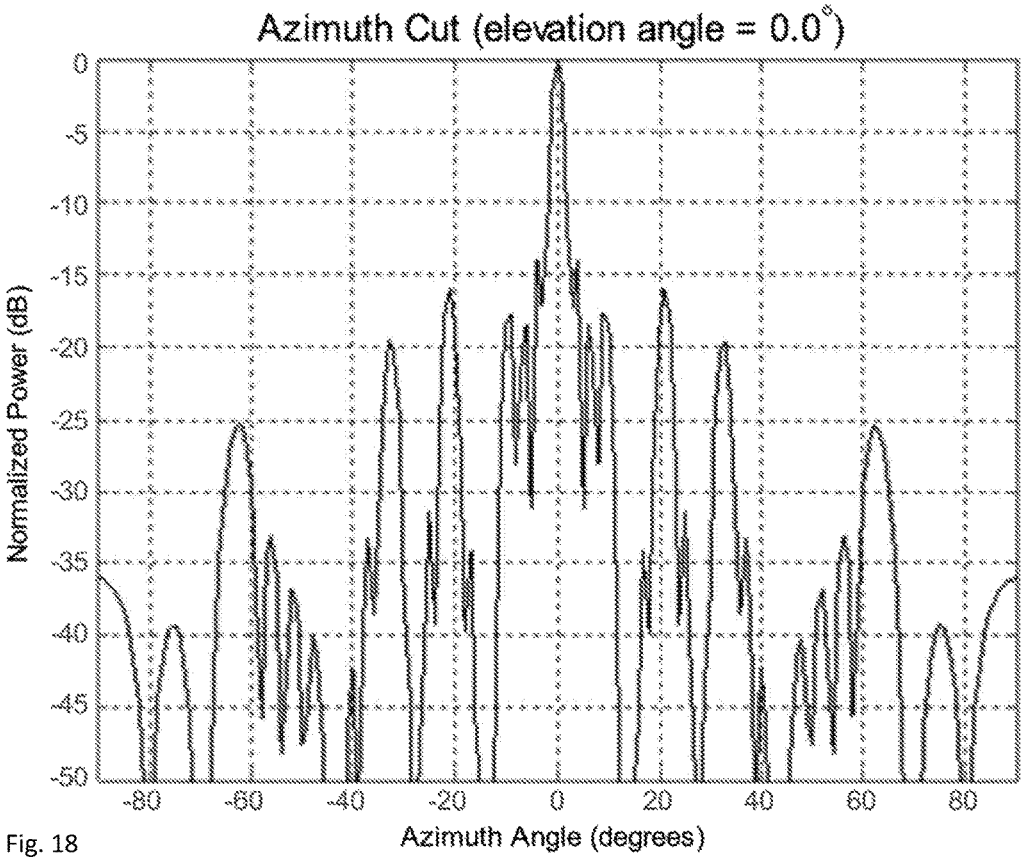
FIG. 18 shows an azimuth cut of the antenna pattern of the exemplary modular antenna array arrangement as shown in FIG. 17 in an aspect of this disclosure.
Figure 19:
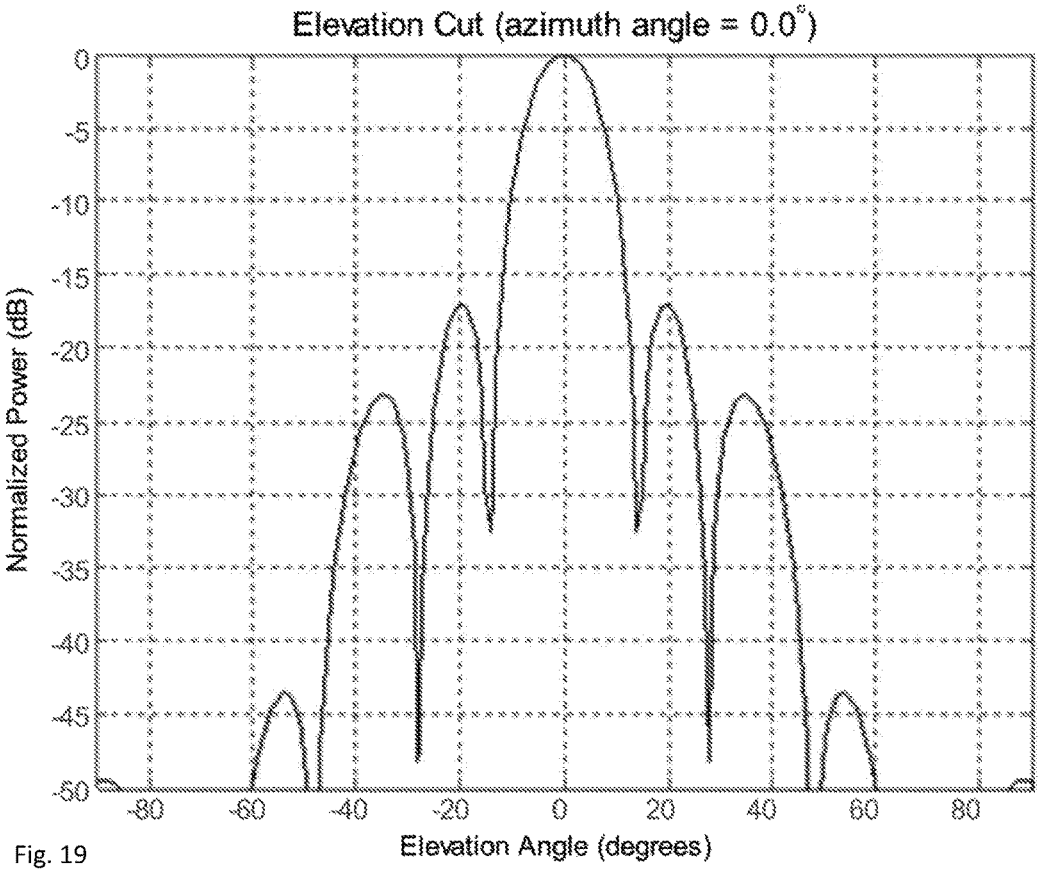
FIG. 19 shows an elevation cut of the antenna pattern of the exemplary modular antenna array arrangement as shown in FIG. 17.

FIG. 18 shows the elevation cut and FIG. 19 shows the azimuth cut. Clearly, FIG. 19 has lower sidelobes than FIG. 14.

Figure 20:
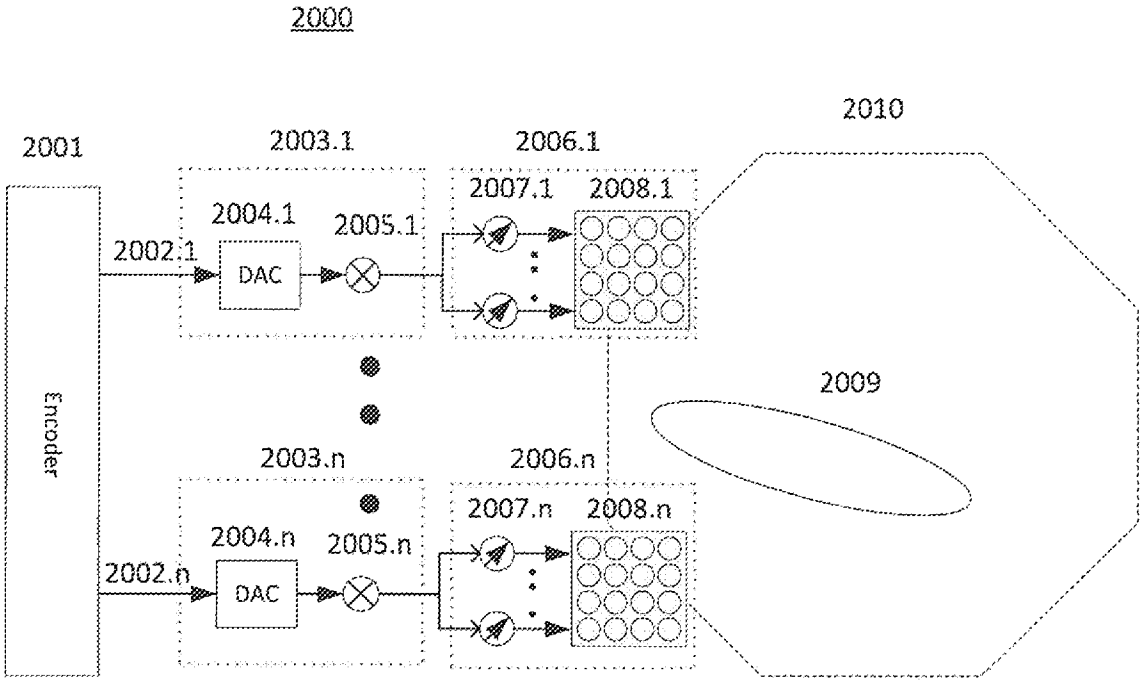
FIG. 20 shows a block a diagram of a transmitter architecture comprising a modular antenna array.

FIG. 20 shows an exemplary communication device 2000, e.g. at a base station, in an aspect of this disclosure. It is appreciated that the communication device 2000 is exemplary in nature and may thus be simplified for purposes of this explanation.

The communication device 2000 includes an encoder 2001 that generates a plurality of digital base-band signals **2002.1-2002.*n***, wherein the index following the dot in the reference indicates the antenna module of a modular antenna array over which the signal is to be transmitted.

The communication device 2000 further includes RFID chips **2003.1-2003.*n* and antenna arrays 2006.1-2006.*n*. Each of the RFID chips 2003.1-2003.*n* includes a digital-to-analog converter (DAC) of DACs 2004.1-2004.*n* and a mixer of mixers 2005.1-2005.*n*, respectively. Each of the antenna arrays 2006.1-2006.*n* includes a plurality of phase shifters 2007.1-2007.*n* and a plurality of antenna elements 2008.1-2008.*n***, respectively.

Digital-to-analog converters **2004.1-2004.*n* convert the digital baseband signals 2002.1-2002.*n* to analog baseband signals. The analog domain includes a plurality of RF-chains. The first RF-chain includes mixer 2005.1, a plurality of phase shifters 2007.1 and antenna array 3207.1 of the first antenna module. The n-th RF-chain includes mixer 2005.*n*, a plurality of phase shifters 2007.*n* and antenna array 2008.*n*** of the n-th antenna module.

Regarding the first RF-chain, mixer 2005.1 converts the analog baseband signal to an analog radio frequency (RF) signal. Each phase shifter of the plurality of phase shifters 2007.1 shifts the phase of the RF signal and feeds the shifted RF signal to its corresponding antenna element of the plurality of antenna elements 2007.1 of the plurality of antenna elements 2008.1 of antenna array 2006.1. The n-th chain operates in a corresponding way.

The antenna modules generate an overall beam 2009 having a beam direction, a main lobe and possibly sidelobes. Signals can be transmitted in direction of the beam over radio channel 2010.

The concept of the design methodology as presented with the present disclosure can be applied to any existing radio modules. No costly and time consuming PCB rework as for a single PCB array design is required. Moreover, the presented MAA design is flexible to change the geometry for different use cases, but a single PCB design does not have this kind of flexibility.

Inherent amplitude tapering can be achieved by an arrangement of existing radio modules, wherein radio modules are staggered and shifted along at least one of a vertical or horizontal dimension. Projection elements of a vertical or horizontal projection include an appropriately chosen number of projected antenna elements.

The arrangement of existing radio modules may be designed to suppress grating lobes and possibly side lobes in order to achieve a high directional overall pattern of the antenna array arrangement possibly having low side lobes.

It is appreciated that implementations of methods detailed herein are demonstrative in nature, and are thus understood as capable of being implemented in a corresponding device. Likewise, it is appreciated that implementations of devices detailed herein are understood as capable of being implemented as a corresponding method. It is thus understood that a device corresponding to a method detailed herein may include a one or more components configured to perform each aspect of the related method.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims, and all changes within the meaning and range of equivalency of the claims are therefore intended to be embraced.

Example 1 includes an antenna array arrangement comprising: a plurality of antenna arrays, each antenna array comprising a plurality of antenna elements; wherein at least two of the plurality of antenna arrays are staggered along at least one of a horizontal dimension or a vertical dimension; and wherein adjacent elements of a projection of the plurality of antenna elements of at least two different antenna arrays of the plurality of antenna arrays onto a horizontal dimension or a vertical dimension have a distance in the order of about half of a wavelength of a transmit signal from the antenna array arrangement.

Example 2 includes the antenna array arrangement of example 1, wherein the distance is less than or equal to about half of a wavelength of a transmit signal from the antenna array arrangement.

Example 3 includes the antenna array arrangement of example 1, wherein the distance is less than about 125% of a wavelength of a transmit signal from the antenna array.

Example 4 includes the antenna array arrangement of any one of examples 1 to 3, wherein adjacent antenna elements of each antenna array are equally spaced apart; and wherein adjacent elements of the projection of the antenna array arrangement onto the horizontal dimension or the vertical dimension are equally spaced apart.

Example 5 includes the antenna array arrangement of any one of examples 1 to 4, wherein each element of the projection of the antenna array arrangement onto the horizontal dimension or the vertical dimension comprises an equal number of projected antenna elements.

Example 6 includes the antenna array arrangement of any one of examples 1 to 5, wherein the projection of the antenna array arrangement onto the horizontal dimension or the vertical dimension comprises a first end portion, a second end portion and a middle portion and wherein a number of antenna elements projected onto each element of the middle portion is larger than a number of antenna elements projected onto each element of the first end portion and the second end portion.

Example 7 includes the antenna array arrangement of example 6, wherein the projection of the antenna array arrangement onto the horizontal dimension or the vertical dimension is symmetric and centered around its middle portion to achieve amplitude tapering.

Example 8 includes the antenna array arrangement of example 6, wherein the projection of the antenna array arrangement onto the horizontal dimension is symmetric and centered around its middle portion and wherein the projection of the antenna array arrangement onto the vertical dimension is symmetric and centered around its middle portion.

Example 9 includes the antenna array arrangement of any one of examples 6 to 8, wherein each element of the projection of the antenna array arrangement onto the vertical dimension comprises an equal number of projected antenna elements; and wherein the projection of the antenna array arrangement onto the horizontal dimension is symmetric and centered around its middle portion with a center element of the projection of the antenna array arrangement onto the horizontal dimension having a number of projected antenna elements that is equal to the number of projected antenna elements onto each element of the projection of the antenna array arrangement onto the vertical dimension.

Example 10 includes the antenna array arrangement of example 9, wherein the projection of the antenna array arrangement onto the horizontal dimension comprises a decreasing number of projected antenna elements towards its first end portion and its second end portion.

Example 11 includes the antenna array arrangement of any one of examples 6 to 8, wherein each element of the projection of the antenna array arrangement onto the horizontal dimension comprises an equal number of projected antenna elements; and wherein the projection of the antenna array arrangement onto the vertical dimension is symmetrical and centered around its middle portion with a center element of the projection of the projection of the antenna array arrangement onto the vertical dimension having a number of projected antenna elements that is equal to the number of projected antenna elements onto each element of the projection of the antenna array arrangement onto the horizontal dimension.

Example 12 includes the antenna array arrangement of example 11, wherein the projection of the antenna array arrangement onto the vertical dimension comprises a decreasing number of projected antenna elements towards its first end portion and its second end portion.

Example 13 includes the antenna array arrangement of any one of examples 1 to 12, further comprising: a plurality of sets of staggered antenna arrays; wherein adjacent antenna arrays of each of the plurality of sets of staggered antenna arrays have an offset along the horizontal dimension or the vertical dimension; and wherein antenna elements of each of the plurality of sets of staggered antenna arrays are aligned along the other one of the horizontal dimension and vertical dimension.

Example 14 includes the antenna array arrangement of example 13, wherein all sets of the plurality of sets of staggered antenna arrays are arranged parallel to each other with an offset along one of the horizontal dimension and the vertical dimension.

Example 15 includes the antenna array arrangement of example 14, wherein antenna elements of an antenna array of a first set of antenna arrays of the plurality of sets of antenna arrays are aligned with antenna elements of an antenna array of a second set of antenna arrays of the plurality of sets of antenna arrays along the one of the horizontal dimension and the vertical dimension.

Example 16 includes the antenna array arrangement of any one of examples 13 to 15, wherein each antenna array comprises 8 antenna elements along the horizontal dimension and 2 antenna elements along the vertical dimension.

Example 17 includes the antenna array arrangement of any one of examples 13 to 16, further comprising: exactly two sets of staggered antenna arrays.

Example 18 includes the antenna array arrangement of any one of examples 13 to 17, wherein adjacent antenna arrays of each of the plurality of sets of staggered antenna arrays have an offset of exactly four antenna elements along the horizontal dimension.

Example 19 includes the antenna array arrangement of any one of examples 13 to 18, wherein all sets of the plurality of sets of staggered antenna arrays are arranged parallel to each other with an offset of exactly two antenna elements along the vertical dimension.

Example 20 includes the antenna array arrangement of example 19, wherein antenna elements of an antenna array of a first set of antenna arrays of the plurality of sets of antenna arrays are aligned with antenna elements of an antenna array of a second set of antenna arrays of the plurality of sets of antenna arrays along the vertical dimension.

Example 21 includes the antenna array arrangement of any of examples 1 to 20, wherein all adjacent elements of a projection of the plurality of antenna elements of the plurality of the antenna arrays onto a horizontal dimension or a vertical dimension have a distance in the order of about half of a wavelength of a transmit signal to from the antenna array arrangement.

Example 22 includes the antenna array arrangement of any one of examples 1 to 21, wherein each antenna array of the plurality of antenna arrays is mounted onto a printed circuit board.

Example 23 includes the antenna array arrangement of any one of examples 1 to 22, further comprising: a plurality of radio frequency integrated circuits; wherein each antenna array of the plurality of antenna arrays is controlled by a separate radio frequency integrated circuit of the plurality of radio frequency integrated circuits.

Example 24 includes the antenna array arrangement of any one of examples 1 to 23, further comprising: a plurality of antenna array modules; wherein each of the plurality of antenna arrays is arranged in a separate antenna array module of the plurality of antenna array modules.

Example 25 includes the antenna array arrangement of example 24, wherein at least some antenna array modules of the plurality of modules are identical.

Example 26 includes the antenna array arrangement comprising: a plurality of antenna arrays, each antenna array comprising a plurality of antenna elements; wherein at least two of the plurality of antenna arrays are staggered along at least one of a horizontal dimension or a vertical dimension; and wherein the distance between an element of a projection of the plurality of antenna elements of a first antenna array of the plurality of antenna arrays onto the horizontal dimension or vertical dimension and another element of a projection of the plurality of antenna elements of a second antenna array of the plurality of antenna arrays onto a horizontal dimension or a vertical dimension is in the order of about half of a wavelength of a transmit signal from the antenna array arrangement.

Example 27 includes the antenna array arrangement comprising: a plurality of antenna arrays, each antenna array comprising a plurality of antenna elements; wherein at least two of the plurality of antenna arrays are staggered along at least one of a horizontal dimension or a vertical dimension; and wherein all adjacent elements of a projection of the plurality of antenna elements of at least two different antenna arrays of the plurality of antenna arrays onto a horizontal dimension or a vertical dimension have a distance in the order of about half of a wavelength of a transmit signal from the antenna array arrangement.

Example 27 includes an apparatus having an antenna array arrangement comprising a plurality of antenna arrays, each antenna array comprising a plurality of antenna elements; wherein at least two of the plurality of antenna arrays are staggered along at least one of a horizontal dimension or a vertical dimension; and wherein all adjacent elements of a projection of the plurality of antenna elements of the plurality of antenna arrays onto a horizontal dimension or a vertical dimension have a distance in the order of about half of a wavelength of a transmit signal from the antenna array arrangement.

What is claimed is:

1. An antenna array arrangement comprising:

a plurality of radio modules, wherein each of the plurality of radio modules comprises an antenna array, and a radio frequency integrated chip;

wherein each antenna array comprises a plurality of antenna elements;

wherein at least two of the plurality of radio modules are staggered along at least one of a horizontal dimension or a vertical dimension; and wherein a distance between adjacent antenna elements of a projection of the plurality of antenna elements of at least two different radio modules of the plurality of radio modules onto a horizontal dimension or a vertical dimension is in the order of about half of a wavelength of a transmit signal from the antenna array arrangement.

2. The antenna array arrangement of claim 1, wherein the distance is less than or equal to about half of a wavelength of a transmit signal from the antenna array arrangement.

3. The antenna array arrangement of claim 1, wherein the distance is less than about 125% of a wavelength of a transmit signal from the antenna array arrangement.

4. The antenna array arrangement of claim 1, wherein adjacent antenna elements of each antenna array are equally spaced apart; and wherein adjacent antenna elements of the projection of the antenna array arrangement onto the horizontal dimension or the vertical dimension are equally spaced apart.

5. The antenna array arrangement of claim 1, wherein each column or row of the projection of the antenna array arrangement onto the horizontal dimension or the vertical dimension respectively comprises an equal number of projected antenna elements.

6. The antenna array arrangement of claim 1, wherein the projection of the antenna array arrangement onto the horizontal dimension or the vertical dimension comprises a first end portion, a second end portion and a middle portion and wherein a number of antenna elements projected onto each column or row respectively of the middle portion is larger than a number of antenna elements projected onto each element of the first end portion and the second end portion.

7. The antenna array arrangement of claim 6, wherein the number of projected antenna elements of the projection of the antenna array arrangement onto the horizontal dimension or the vertical dimension is symmetric and centered around its middle portion.

8. The antenna array arrangement of claim 6, wherein the projection of the antenna array arrangement onto the horizontal dimension is symmetric and centered around its middle portion and wherein the projection of the antenna array arrangement onto the vertical dimension is symmetric and centered around its middle portion.

9. The antenna array arrangement of claim 6, wherein each row of the projection of the antenna array arrangement onto the vertical dimension comprises an equal number of projected antenna elements; and wherein the projection of the antenna array arrangement onto the horizontal dimension is symmetric and centered around its middle portion with a center column of the projection of the antenna array arrangement onto the horizontal dimension having a number of projected antenna elements that is equal to the number of projected antenna elements onto each row of the projection of the antenna array arrangement onto the vertical dimension.

10. The antenna array arrangement of claim 9, wherein the projection of the antenna array arrangement onto the horizontal dimension comprises a decreasing number of projected antenna elements towards its first end portion and its second end portion.

11. The antenna array arrangement of claim 6, wherein each column of the projection of the antenna array arrangement onto the horizontal dimension comprises an equal number of projected antenna elements; and wherein the projection of the antenna array arrangement onto the vertical dimension is symmetrical and centered around its middle portion with a center row of the projection of the antenna array arrangement onto the vertical dimension having a number of projected antenna elements that is equal to the number of projected antenna elements onto each column of the projection of the antenna array arrangement onto the horizontal dimension.

12. The antenna array arrangement of claim 11, wherein the projection of the antenna array arrangement onto the vertical dimension comprises a decreasing number of projected antenna elements towards its first end portion and its second end portion.

13. The antenna array arrangement of claim 1, further comprising:

a plurality of sets of staggered radio modules;

wherein adjacent radio modules of each of the plurality of sets of staggered radio modules have an offset along the horizontal dimension or the vertical dimension; and wherein antenna elements of each of the plurality of sets of staggered radio modules are aligned along the other one of the horizontal dimension and vertical dimension.

14. The antenna array arrangement of claim 13, wherein all sets of the plurality of sets of staggered radio modules are arranged parallel to each other with an offset along one of the horizontal dimension and the vertical dimension.

15. The antenna array arrangement of claim 14, wherein antenna elements of a radio module of a first set of radio modules of the plurality of sets of radio modules are aligned with antenna elements of a radio module of a second set of radio modules of the plurality of sets of radio modules along the horizontal dimension or the vertical dimension.

16. The antenna array arrangement of claim 13, wherein the antenna array of each radio module comprises eight antenna elements along the horizontal dimension and two antenna elements along the vertical dimension.

17. The antenna array arrangement of claim 13, further comprising:

exactly two sets of staggered radio modules.

18. The antenna array arrangement of claim 13, wherein adjacent antenna arrays of each of the plurality of sets of staggered radio modules have an offset of exactly four antenna elements along the horizontal dimension.

19. The antenna array arrangement of claim 13, wherein all sets of the plurality of sets of staggered radio modules are arranged parallel to each other with an offset of exactly two antenna elements along the vertical dimension.

20. The antenna array arrangement of claim 19, wherein antenna elements of the antenna array of the radio module of a first set of radio modules of the plurality of sets of radio modules are aligned with antenna elements of an antenna array of a second set of radio modules of the plurality of sets of radio modules along the vertical dimension.

21. The antenna array arrangement of claim 1, wherein all adjacent antenna elements of the projection of the plurality of antenna elements of the plurality of the radio modules onto a horizontal dimension or a vertical dimension have a distance in the order of about half of a wavelength of a transmit signal from the antenna array arrangement.

22. The antenna array arrangement of claim 1, wherein each antenna element of the antenna array of the plurality of radio modules is mounted onto a printed circuit board.

23. The antenna array arrangement of claim 1, wherein each radio module of the plurality of radio modules is controlled by the radio frequency integrated circuit.

24. Antenna array arrangement comprising:

a plurality of antenna arrays, each antenna array comprising a plurality of antenna elements;

wherein at least two of the plurality of antenna arrays are staggered along at least one of a horizontal dimension or a vertical dimension; and wherein the distance between an element of a projection of the plurality of antenna elements of a first antenna array of the plurality of antenna arrays onto the horizontal dimension or vertical dimension and another element of a projection of the plurality of antenna elements of a second antenna array of the plurality of antenna arrays onto a horizontal dimension or a vertical dimension is in the order of about half of a wavelength of a transmit signal from the antenna array arrangement.

25. Antenna array arrangement comprising:

a plurality of antenna arrays, each antenna array comprising a plurality of antenna elements;

wherein at least two of the plurality of antenna arrays are staggered along at least one of a horizontal dimension or a vertical dimension; and wherein all adjacent elements of a projection of the plurality of antenna elements of at least two different antenna arrays of the plurality of antenna arrays onto a horizontal dimension or a vertical dimension have a distance in the order of about half of a wavelength of a transmit signal from the antenna array arrangement.

* * * * *